US005110075A

United States Patent [19]

Reid et al.

[11] Patent Number: 5,110,075

[45] Date of Patent: May 5, 1992

[54] POOL SWEEPER HOSE CLAMP

[76] Inventors: Douglas B. Reid, 1017 Folsom Ranch Dr., #301, Folsom, Calif. 95630; Bruce A. Christie; Beth A. Christie, both of 7051 Newton Pl., Rancho Cucamonga, Calif. 91730

[21] Appl. No.: 692,948

[22] Filed: Apr. 29, 1991

[51] Int. Cl.[5] ..... E04H 4/16

[52] U.S. Cl. ..... 248/79; 4/490; 4/496; 15/246; 134/167 R

[58] Field of Search ..... 248/75, 78, 205.1, 30 A, 248/79; 15/1.7, 246; 134/167 R; 4/490, 496, 503, 505; 52/70 A, 706; 24/599.2

[56] References Cited

U.S. PATENT DOCUMENTS 1,485,596 3/1924 Chase ..... 52/706
1,606,872 11/1926 Freyn ..... 52/706
2,466,912 4/1949 Rice ..... 248/74
2,636,704 4/1953 Norberg ..... 248/79
3,972,077 8/1976 Whitten, Jr. ..... 4/496
4,018,469 4/1977 Stoops ..... 24/599.2 X
4,228,553 10/1980 Genuit ..... 4/490
4,417,710 11/1983 Adair ..... 248/51
5,005,229 4/1991 Bertoni ..... 4/496 X

*Primary Examiner*—Carl D. Friedman
*Assistant Examiner*—Derek J. Berger
*Attorney, Agent, or Firm*—Henri J. A. Charmasson

[57] ABSTRACT

A clamp assembly mounted against the wall of a swimming pool at water level has a folding hook shaped and dimensioned to moor the hose of a pool sweeper or other floating objects, and prevent its drifting toward a used section of the pool. The hook, when not in use, folds back flush into its mounting base plate out of harm's way of any swimmer or diver.

9 Claims, 2 Drawing Sheets

POOL SWEEPER HOSE CLAMP

FIELD OF THE INVENTION

This invention relates to swimming pool accessories, and more specifically to pool cleaning sweepers or vacuum cleaners.

BACKGROUND OF THE INVENTION

Many swimming pools are equipped with automatic sweepers which continuously and randomly sweep the bottom and sides of the pool, removing fallen leaves or other debris. The skimming head of the sweeper is trailed by a hose which snakes over a large section of the pool surface. The hose interferes with the use of the pool by swimmers, and thus the entire sweeper apparatus has to be removed before the pool can be used. The removal of the hose and sweeper from the pool and its subsequent reinstallation is a difficult and time consuming task which often requires refilling the hose with water.

There is a need for a device that would allow use of the pool without having to remove the pool sweeping equipment.

SUMMARY OF THE INVENTION

The principal and secondary objects of this invention are to provide a device for mooring the hose of a pool sweeping machine or any other floating object such as a buoy or a pool partitioning rope to the edges of the pool while it is being used by swimmers and divers; and to do so without interfering with such use of the pool or creating any hazard to the users, but on the contrary, to turn such objects into unsinkable structures which can be grabbed by a swimmer in distress or a non-swimmer who has accidentally fallen into the pool.

These and other objects are achieved by means of a series of clamp assemblies which are mounted against the wall of the swimming pool at water level or below. Each assembly has a folding hook shaped to capture sections of a pool sweeper hose or other floating object. When not in use the hook folds back into a recess of its mounting plate out of harm's way of any swimmer or diver.

DESCRIPTION OF THE PREFERRED EMBODIMENT OF THE INVENTION

Figure 1:
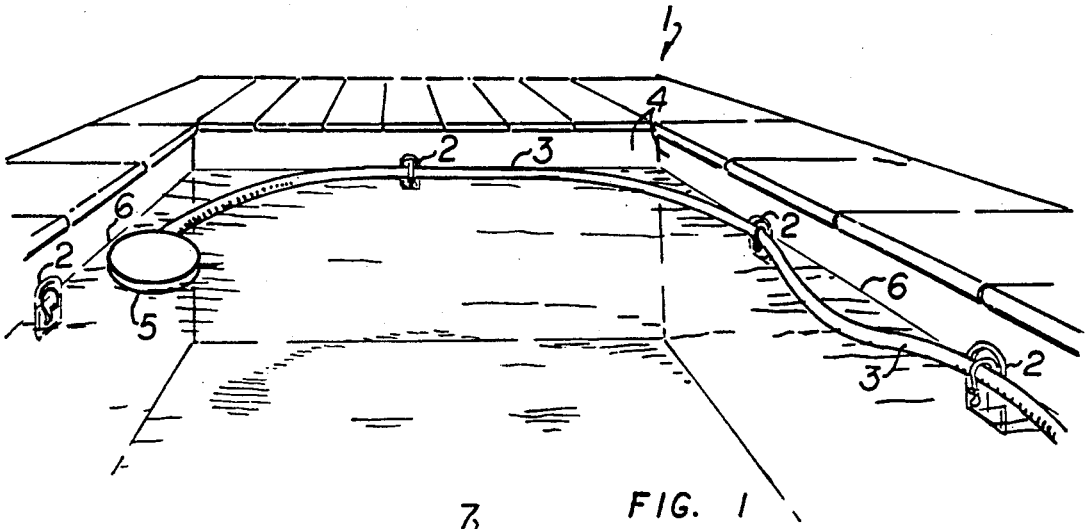
FIG. 1 is a perspective view of a swimming pool equipped with the invention.
Figure 2:
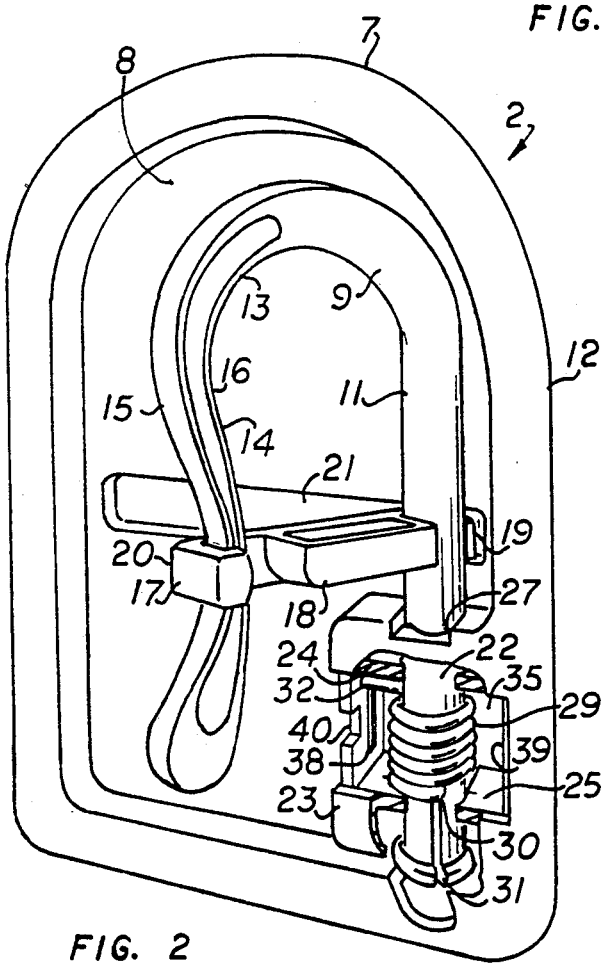
FIG. 2 is a perspective view of a clamping assembly.

Referring now to the drawing, there is shown in FIG. 1 a pool 1 equipped with a series of clamping assemblies 2 which are used to moor a floating hose 3 against the edges 4 of the pool.

In this particular application, the hose 3 is associated with an automatic pool sweeping apparatus 5 which, if not moored, will float over the entire surface of the pool sucking fallen leaves and other debris. The series of clamping assemblies 2 are mounted below the level of the normal water surface 6. Keeping the clamping assemblies below the water level limits the effect of solar radiation on their plastic components. The clamp assemblies are more specifically illustrated in the following figures.

Each clamp assembly comprises a base plate 7 which forms a frontal open cavity 8. Cavity 8 is shaped and sized to house a rotatable hook 9 in its rest or unused position. Each clamping assembly has a substantially flat backplane 10 which can be glued or cemented against the walls of the pool. A peripheral flange 12 projecting from that backplane defines the walls of the cavity 8.

Figure 4:
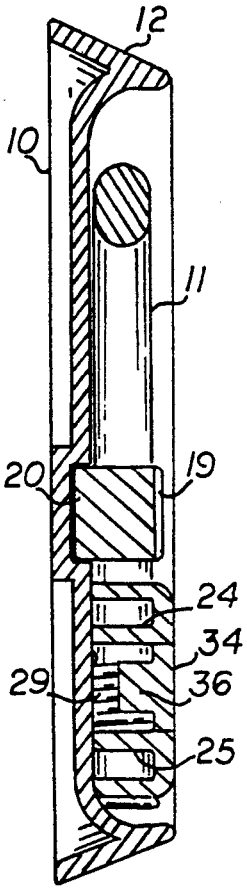
FIG. 4 is a cross-sectional view taken along line 4—4 of FIG. 3.
Figure 3:
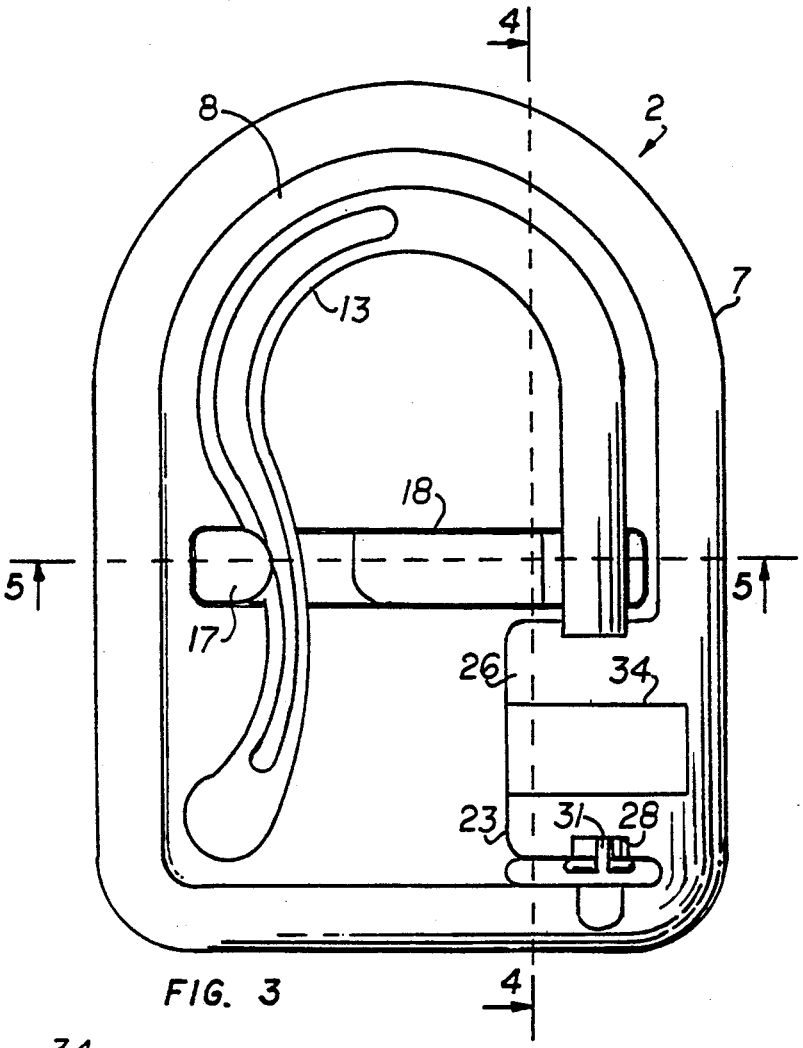
FIG. 3 is a front elevational view thereof.
Figure 5:
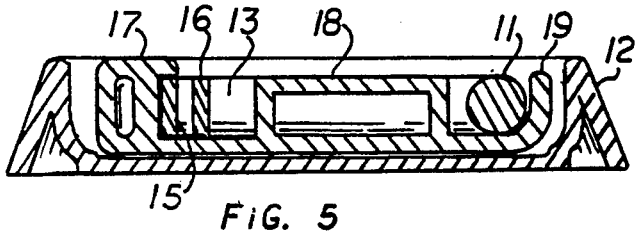
FIG. 5 is a cross-sectional view taken along line 5—5 of FIG. 3.

The hook 9 comprises a substantially straight shank 11 and an open loop 13 which forms a bay shaped and dimensioned to capture a section of the hose 3. The hook 9 is made of a resiliently flexible synthetic material and a large section 14 of the open loop 13 is split into two strips 15, 16 for added flexibility. The split section 14 of the open loop 13 has a dog-leg shape and may be captured in the hooked end 17 of a removable bracket 18 which is rotatively mounted at its opposite end 19 around the shank 11 of the hook. The bracket 18 is optionally used to safely secure the section of the hose 3 into the bay of the hook. The back portion 20 of the bracket 18 nests in a small recess 21 of the backplane 10 of the assembly. The recess 21 allows the hook to nest flush into the cavity 8 as illustrated in FIGS. 3–5 out of harm's way of any swimmer or diver when the device is not in use.

When possible, it may be advantageous to install the clamp assembly in small niches cut into the pool walls so that the front edges of the bare plates are flush with the surface of the walls.

The foot of the shank 11 is rotatively mounted into a hollowed base 23 in the lower right corner of the cavity 8. The foot 22 of the shank 11 is held by two semi-circular bearings 24, 25 projecting from the back of the front wall 26, and openings 27, 28 in the top and bottom of the base 23. Between the two bearing projections a coil spring 29 is coaxially mounted around the foot section 22, with one end 30 of the coil spring engaging a slot 31 in the foot 22 of the shank, and the other end 32 being straightened to press against the supporting pool wall. Accordingly, the rotative position of the hook is resiliently biased toward the rest position within the cavity.

The clamping assemblies should be installed 10 to 15 centimeters below the water level to keep the hose 3 submerged, thus reducing the decomposing effect of solar radiations on the hose material.

The entire clamping assembly is made from a synthetic material such as P/PE copolymer with relatively high resistance to exposure to outside elements and clorinated water. The device is engineered for easy assembly and convenient replacement of the moving parts such as the hook 9 and bracket 18 without having to detach the housing or backplate 7 from the pool wall.

Figure 6:
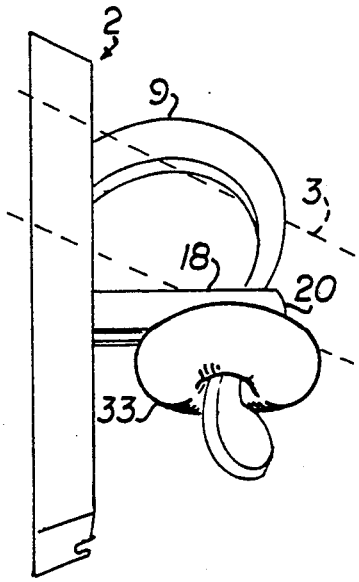
FIG. 6 is a side view of a hook equipped with an auxiliary clamp.

FIG. 6 illustrates a toroidal ring 33 made of foam rubber or other spongy material. The ring 33 is placed around the lower part of the dog-leg-shaped section of the loop 14 either solely or in combination with the bracket 18 to more tightly capture a small diameter hose or rope within the bay of the hook.

Figure 7:
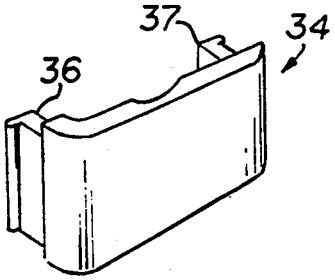
FIG. 7 is a perspective view of the removable spring housing cover.

FIG. 7 illustrates the lid 34 which covers the window 35 in the hollowed base 23 over the area housing the coil spring 29. This lid snaps into place when its two projections 36, 37 engages depressions 38, 39 in the inside wall surfaces of the base 23. A wall notch 40 in the left edge of the window 35 can be engaged by the tip of a screw-driver or other objects used to pry the lid open. The window 35 provides a convenient access for the removal and replacement of a broken or worn-out coil spring.

It can now be understood that the above-described embodiment of the invention constitutes a substantial improvement to the safety of a pool equipped with an automatic sweeper by keeping the sweeper hose out of the way of swimmers and, thus preventing entanglement; but also by turning the sweeper hose into a firmly anchored safety line strung around the periphery of the pool.

While the preferred embodiments of the invention have been described, modifications can be made and other embodiments may be devised without departing from the spirit of the invention and the scope of the appended claims.

What is claimed is:

1. In combination with a swimming pool, a clamp assembly for mooring a sweeper hose or other floating objects to a wall of the pool at water level which comprises:

a baseplate comprising a peripheral frame and a backplane, said baseplate having a shallow frontal housing cavity;

means for mounting said baseplate against said wall;

a hook having a substantially linear shank and an open loop shaped and dimensioned to form a bay for capturing a part of said floating objects; and means for holding the shank of the hook in a position parallel to said backplane and inside the housing cavity;

wherein said means for holding comprise means for rotatively mounting the shank about its own axis.

2. In combination with a swimming pool, a clamp assembly for mooring a sweeper hose or other floating objects to a wall of the pool at water level which comprises:

a baseplate comprising a peripheral frame and a backplane, said baseplate having a sallow frontal housing cavity;

means for mounting said baseplate against said wall;

a hook having a shank and an open loop shaped and dimensioned to form a bay for capturing a part of said object; and means for securing the shank of the hook inside the housing cavity, wherein said means for securing comprise means for rotatively mounting the shank against the backplane including means for resiliently biasing the rotation of the hook toward a rest position within the housing cavity.

3. The combination of claim 2, which further comprises means for closing the open loop around said part.

4. The combination of claim 3, wherein said means for closing comprise a latching member having a first end rotatively engaged around the shank of the hook and an opposite second end having means for latching over the loop of he hook, said member being sized to bridge said bay.

5. The combination of claim 4, wherein said backplane defines a recess shaped and dimensioned to house said latching member behind said hook.

6. The combination of claim 3, wherein said open loop is made of resilient flexible material.

7. The combination of claim 3, wherein said means for closing comprise a toroidal body made of elastomeric material, said body being sized to resiliently engage a end section of said loop.

8. The combination of claim 2, wherein said means for resiliently biasing comprise a coil spring coaxially mounted around said shank.

9. The combination of claim 2, wherein said backplane is mounted against said wall at said water level.

* * * * *